US005687660A

United States Patent [19]

Honda et al.

[11] Patent Number: 5,687,660

[45] Date of Patent: Nov. 18, 1997

[54] CLOTH EDGE CONTROL DEVICE FOR A SEWING MACHINE

[75] Inventors: Hiroshi Honda; Nozomi Iwasaki, both of Tokyo, Japan

[73] Assignee: Juki Corporation, Tokyo, Japan

[21] Appl. No.: 406,794

[22] Filed: Mar. 20, 1995

Related U.S. Application Data

[63] Continuation of Ser. No. 227,107, Apr. 13, 1994, abandoned.

[30] Foreign Application Priority Data

Apr. 13, 1993 [JP] Japan ..... 5-024436 U

[51] Int. Cl.[6] ..... D05B 21/00

[52] U.S. Cl. ..... 112/470.03; 112/470.07; 112/306; 112/308; 112/318; 112/153; 226/17

[58] Field of Search ..... 112/121.11, 306, 112/308, 121.12, 318, 322, 314, 312, 313, 320, 470.03, 470.07, 470.06, 470.01; 226/15, 17

[56] References Cited

U.S. PATENT DOCUMENTS 4,417,535 11/1983 Hannemann .
4,643,118 2/1987 Bungert et al. .
5,020,460 6/1991 Babson et al. ..... 112/306 X
5,186,115 2/1993 Rouleau et al. ..... 112/121.11 X
5,289,788 3/1994 Fukumoto ..... 112/121.12
5,415,118 5/1995 Adamski, Jr. et al. ..... 112/470.03
5,493,980 2/1996 Nishimori et al. ..... 112/470.03
5,497,720 3/1996 Kawasaki ..... 112/306 X

FOREIGN PATENT DOCUMENTS 3-44548 7/1991 Japan .

*Primary Examiner*—Peter Nerbun
*Attorney, Agent, or Firm*—Finnegan, Henderson, Farabow, Garrett & Dunner, L.L.P.

[57] ABSTRACT

A cloth edge control device for a sewing machine includes a pair of rollers, an optical sensor, and controller. The pair of rollers are arranged near a needle location in such a manner that the rollers are rotating about an axis perpendicular to a direction in which a cloth material is fed, so as to be pushed against the cloth material. The optical sensor is adapted for detection of the cloth material at a plurality of points on a line along a direction intersecting with the feed direction before the needle location. The controller detects the position and curvature of the edge of the cloth material according to a light intercept signal from the optical sensor and rotates the rollers independently of each other according to the position and curvature thus detected.

4 Claims, 7 Drawing Sheets

CLOTH EDGE CONTROL DEVICE FOR A SEWING MACHINE

This application is a continuation, of application Ser. No. 08/227,107, filed Apr. 13, 1994, now abandoned.

BACKGROUND OF THE INVENTION

1. Field of Invention

This invention relates to a cloth edge control device for a sewing machine.

2. Description of Related Art

A sewing machine for automatically sewing two pieces of cloth materials having curved cloth edges different in configuration while aligning the cloth edges with each other, has been well known, for instance, from the disclosure in Examined Japanese Patent Publication No. Hei. 3-44548.

In an automatic sewing machine, in order to detect the positions of the edges of two pieces of cloth materials (hereinafter referred to as "cloth edges", when applicable) laid one on another, pairs of light emitting elements and light receiving elements are arranged respectively above and below the separating board before the needle location. In order to irradiate the light receiving elements uniformly, the light emitting elements are, for instance, linear incandescent lamps, and the light receiving elements are, for instance, solar cells.

The cloth materials, when fed, are passed through the spaces between the light emitting elements and the light receiving elements which, as described above, are located above and below the separating board, respectively. The cloth materials thus passed intercept the rays from the light emitting elements, thus varying the quantities of light received by the light receiving elements. The variations in the quantity of light are utilized to detect the positions of the cloth edges. The cloth edge position data thus detected are applied to a CPU (central processing unit), so that the cloth materials are moved in the cloth material feeding direction by the feed dog while being moved in a direction perpendicular to the cloth material feeding direction by moving rollers, whereby the cloth edge portions are sewed together.

The above-described conventional sewing machine suffers from the following problems:

With the sewing machine, the cloth materials are adjusted in position being moved in and out so that the cloth edges are aligned with each other in a direction perpendicular to the cloth material feeding direction irrespective of the movement of the feed dog. This adjustment stretches the cloth materials, thus giving rise to a feed pitch error and a misalignment.

In view of the foregoing, a first object of the invention is to provide a cloth edge control device for a sewing machine which prevents the occurrence of the above-described feed pitch error and misalignment.

A second object of the invention is to provide a cloth edge control device for a sewing machine which allows cloth material feeding rollers to operate in synchronization with the upper shaft of the sewing machine.

SUMMARY OF THE INVENTION

One aspect of the present invention is to provide a cloth edge control device for a sewing machine including:

a pair of rollers arranged near a needle location in such a manner that the rollers are rotating about an axis perpendicular to a direction in which a cloth material is fed, so as to be pushed against the cloth material;

an optical line sensor arranged upstream against the needle location; and controller for detecting the position and curvature of the edge of the cloth material according to a light intercept signal from the optical line sensor, and for rotating the rollers independently of each other according to the position and curvature thus detected.

Another aspect to the present invention is to provide a cloth edge control device for a sewing machine including:

a pair of rollers arranged near a needle location in such a manner that the rollers are rotating about an axis perpendicular to a direction in which a cloth material is fed, so as to be pushed against the rollers;

a plurality of optical point sensors arranged before the needle location; and controller for detecting the posture of the edge of the cloth material according to light intercept signals from the optical pint sensors and for rotating the rollers independently of each other according to the posture as detected.

Another aspect to the present invention is to provide the cloth edge control device further including, a pulse generator for generating a pulse signal in response to the rotation of the upper shaft of the sewing machine, and frequency dividers for dividing a roller drive signal from the controller by the output of the pulse generator which serves as a fundamental clock.

According to one aspect of the present invention, the controller detects the position and curvature of the edge of the cloth material from the light-intercepted area of the line sensor. By changing the speed ratios of the rollers according to the data thus detected, the margin to sew up and the cloth material feeding operation are controlled concurrently in the feed direction to prevent the cloth material from stitching before the needle location.

According to another aspect of the present invention, the controller detects the posture of the cloth material depending upon whether there is light-interception or not, of a plurality of point sensors. Similarly as in the above-described manner, by changing the speed ratios of the rollers according to the data thus detected, the margin to sew up and the cloth material feeding operation are controlled concurrently in the feed direction to prevent the cloth material from stretching before the needle location.

Furthermore, in the cloth edge control device according to the present invention, the pulse signal generated in response to the rotation of the upper shaft of the sewing machine is employed as the fundamental clock signal for the frequency dividers adapted to divide the roller drive signal from the controller by the output of the pulse generator. Therefore, the rollers are operated in synchronization with the upper shaft of the sewing machine. And the means for operating the rollers in this manner is simple in construction, being not mechanical.

DETAILED DESCRIPTION OF THE PREFERRED EMBODIMENTS

Preferred embodiments of this invention will be described with reference to the accompanying drawings.

Figure 1:
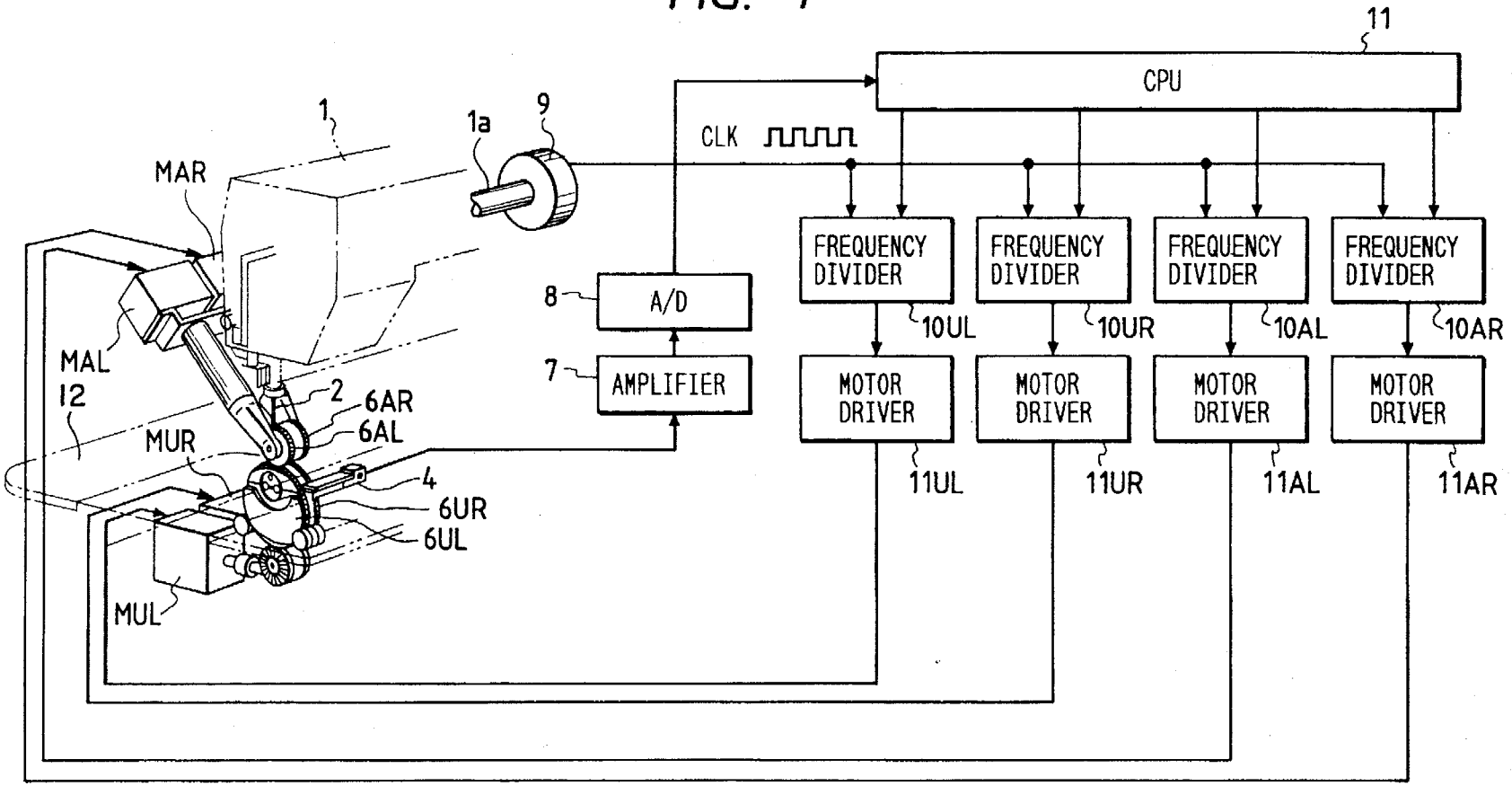
FIG. 1 is an explanatory diagram outlining the whole arrangement of a cloth edge control device for a sewing machine, which constitutes a first embodiment of the invention.
Figure 2:
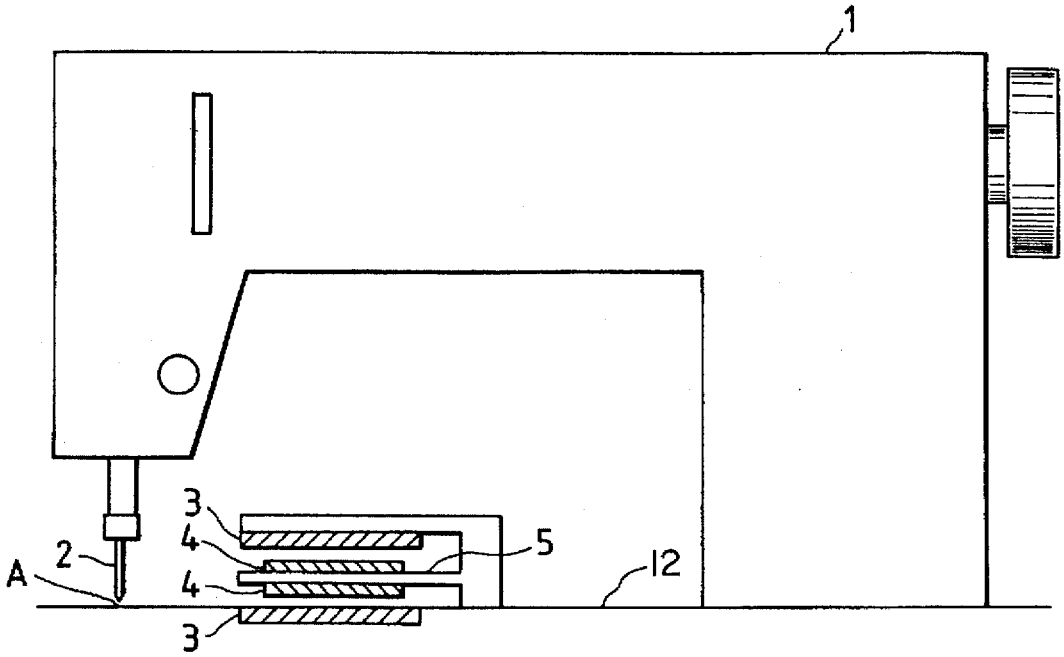
FIG. 2 is a side view of optical line sensors and parts around them in the device shown in FIG. 1.
Figure 3:
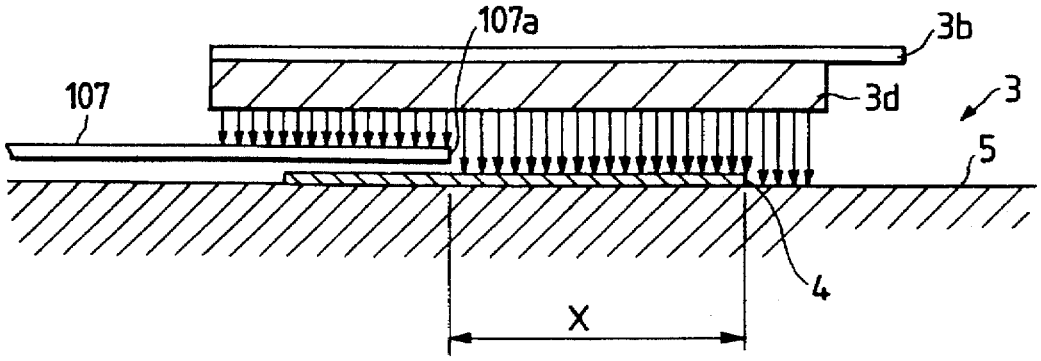
FIG. 3 is an enlarged diagram of the optical line sensor for the upper cloth material shown in FIG. 2.
Figure 4:
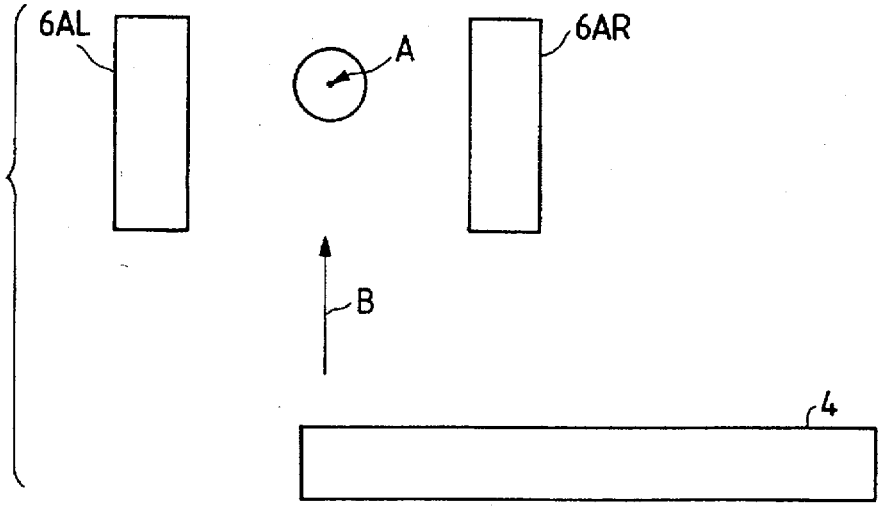
FIG. 4 is a top view of a needle location and parts around it in the device shown in FIG. 1.

FIG. 1 is an explanatory diagram outlining the arrangement of a cloth edge control device for a sewing machine, which constitutes a first embodiment of the invention. FIG. 2 is a side view of optical line sensors shown in FIG. 1. FIG. 3 is an enlarged diagram of the optical line sensor for the upper cloth material shown in FIG. 2. FIG. 4 is a top view of a needle location and parts around it which are shown in FIG. 1. The cloth edge control device is applied to a sewing machine which automatically stitches two pieces of cloth materials having curved cloth edges different in configuration together while aligning the cloth edges of them with each other.

In FIGS. 1 and 2, reference numeral 1 designates a sewing head; and 2, a sewing needle. As shown in FIG. 2, upstream against a needle position A (cf. FIG. 4), light emitting elements, namely, planar light emitting LED panels 3, and light receiving elements of single crystal type, namely, solar cells 4 are arranged vertically in such a manner that the former confront with the latter. The planar light emission LED panels 3 and the solar cells 4 form two optical line sensors with the aid of a separating board 5. That is, one of the optical line sensors is for the upper cloth material, and the other is for the lower cloth material.

The planar light emitting LED panel 3, as shown in FIG. 3, comprises: a printed circuit board 3*b*; a plurality of LED element chips arranged on the printed circuit board 3*b* in matrix form or linearly at equal intervals; a casing 3*d* covering those LED element chips (not shown); and a light diffusing semi-transparent film (not shown) covering the side of the casing which is opposite to the side where the printed circuit board is provided. When activated, the LED element chips output the rays of light which are uniform in the quantity of light over the light-diffusing semi-transparent film. Each of the planar light emitting LED panels 3 is in the form of a flat plate.

In each of the optical line sensors, there is a predetermined space (distance) between the planar light emitting LED panel 3 and the solar cell 4. The upper (or lower) cloth material 107 passes through the space during a sewing operation.

As shown in FIGS. 1 and 4, upper-cloth-material feeding rollers 6AL (on the left side as viewed in a cloth material feeding direction B) and 6AR (on the right side as viewed in the direction B) are rotatable and provided on both sides of the needle location A over a throat plate 12 of the sewing machine, in such a manner that they are rotating about an axis perpendicular to the cloth material feeding direction B. Furthermore, as shown in FIG. 1, lower-cloth-material feeding rollers 6UL (on the left side as viewed in the direction B) and 6UR (on the right side as view in the direction B) are also rotatable and provided on both sides of the needle position A under the throat plate 12, rotating about such a manner that they are in an axis perpendicular to the cloth material feeding direction B. The upper-cloth-material feeding rollers 6AL and 6AR are so designed that they are able to push the upper cloth material, and the lower-cloth material feeding rollers 6UL and 6UR are also so designed that they are able to push the lower cloth material.

The upper-cloth-material feeding rollers 6AL and 6AR are driven by upper-cloth-material feeding motors MAL and MAR, respectively. The lower-cloth-material feeding rollers 6UL and 6UR are driven by lower-cloth-material feeding motors MUL and MUR, respectively.

The solar cells 4 for the upper and lower cloth materials (hereinafter referred to as "the upper cloth material solar cell 4, and the lower cloth material solar cell 4", when applicable) are connected to amplifiers 7, respectively, which are connected to A/D (analog-to-digital) converters 8 adapted to convert analog signals into digital signals, respectively. The A/D converters 8 are connected to controller 11 (described later in detail) which, in response to light intercept signals from the upper cloth material solar cell 4 and the lower cloth material solar cell 4; i.e., in response to output signals of the A/D converters 8, detects the positions and curvatures of the cloth edges, and controls the rotations of the upper-cloth-material feeding rollers 6AL and 6AR and the lower-cloth-material feeding rollers 6UL and 6UR individually. The controller 11 is connected to frequency dividers 10AL, 10AR, and 10UL and 10UR which divide roller drive signals outputted by the controller by the output of the pulse generator.

A pulse generator, namely, an encoder 9 is connected to an upper shaft 1*a* of the sewing machine, and its output is connected to the fundamental clock terminals of the frequency dividers 10AL, 10AR, 10UL and 10UR. The frequency dividers 10AL, 10AR, 10UL and 10UR are connected to motor drivers 11AL, 11AR, 11UL and 11UR, respectively, which drive the upper-cloth-material feeding motors MAL and MAR, and the lower cloth-material feeding motors MUL and MUR separately.

For simplification in illustration, in FIG. 1 the optical lines sensor (the planar light emitting LED panel 3 and the solar cell 4) for the lower cloth material, the amplifier 7 for lower cloth material, the A/D converter 8 for lower cloth material, and the planar light emitting LED panel 3 for upper cloth material are not shown; and in FIG. 2 the upper-cloth-material feeding rollers 6AL and 6AR are not shown.

The controller 11 is adapted to apply a roller drive signal to the frequency dividers 10AL, 10AR, 10UL and 10UR in response to the light intercept signals from the A/D converters 8. The controller 11 is a micro-computer in this embodiment. In the micro-computer, programs have been written in its ROM, so that various set values and data tables are stored and processed. The programs written in the ROM are as shown in FIGS. 8 and 9, flow charts.

The operation of the cloth edge control device according to the flow charts of the present invention will be described.

Figure 8:
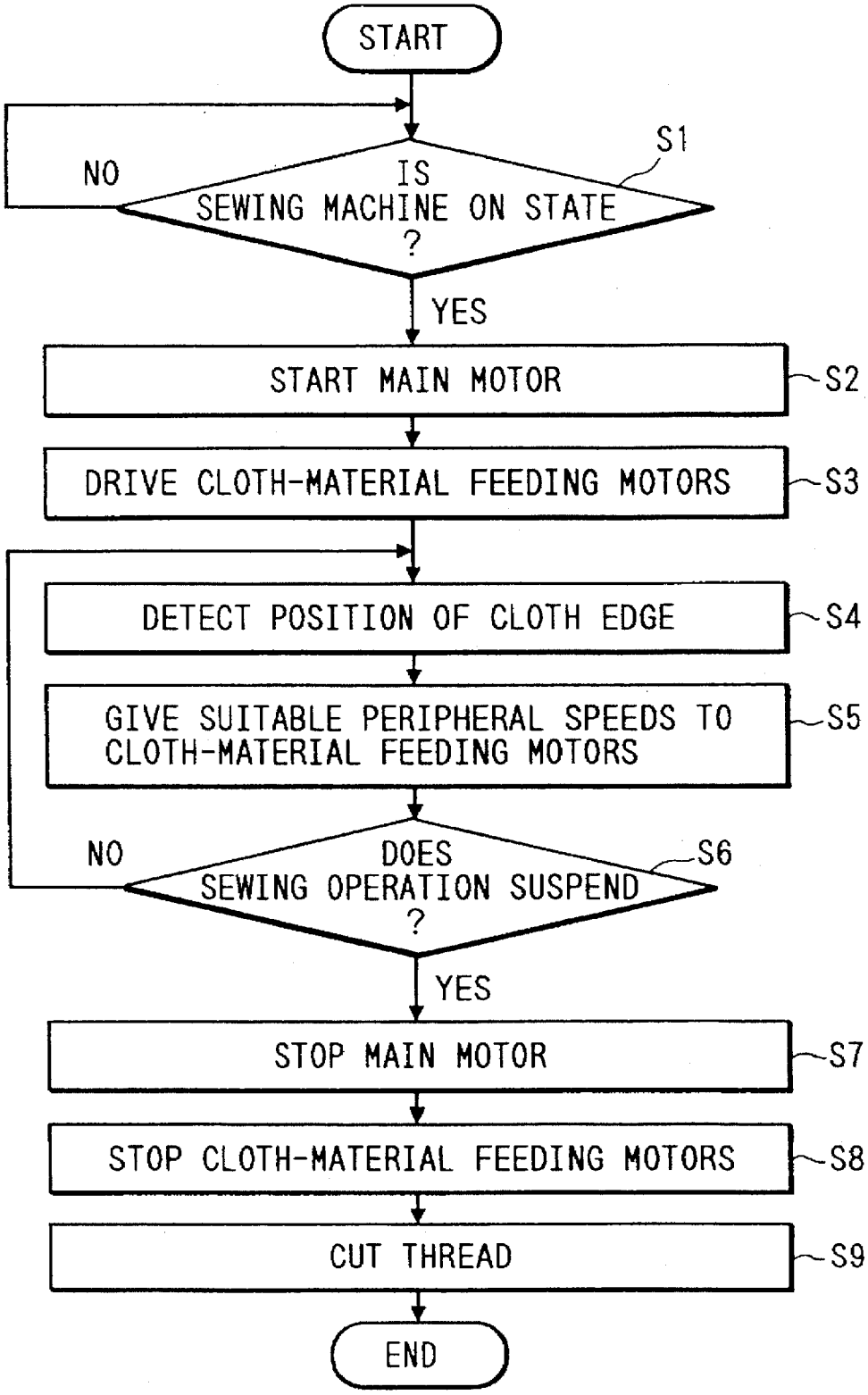
FIG. 8 is a flow chart showing a program stored in controller in the case where the cloth material is moved continuously.
Figure 9:
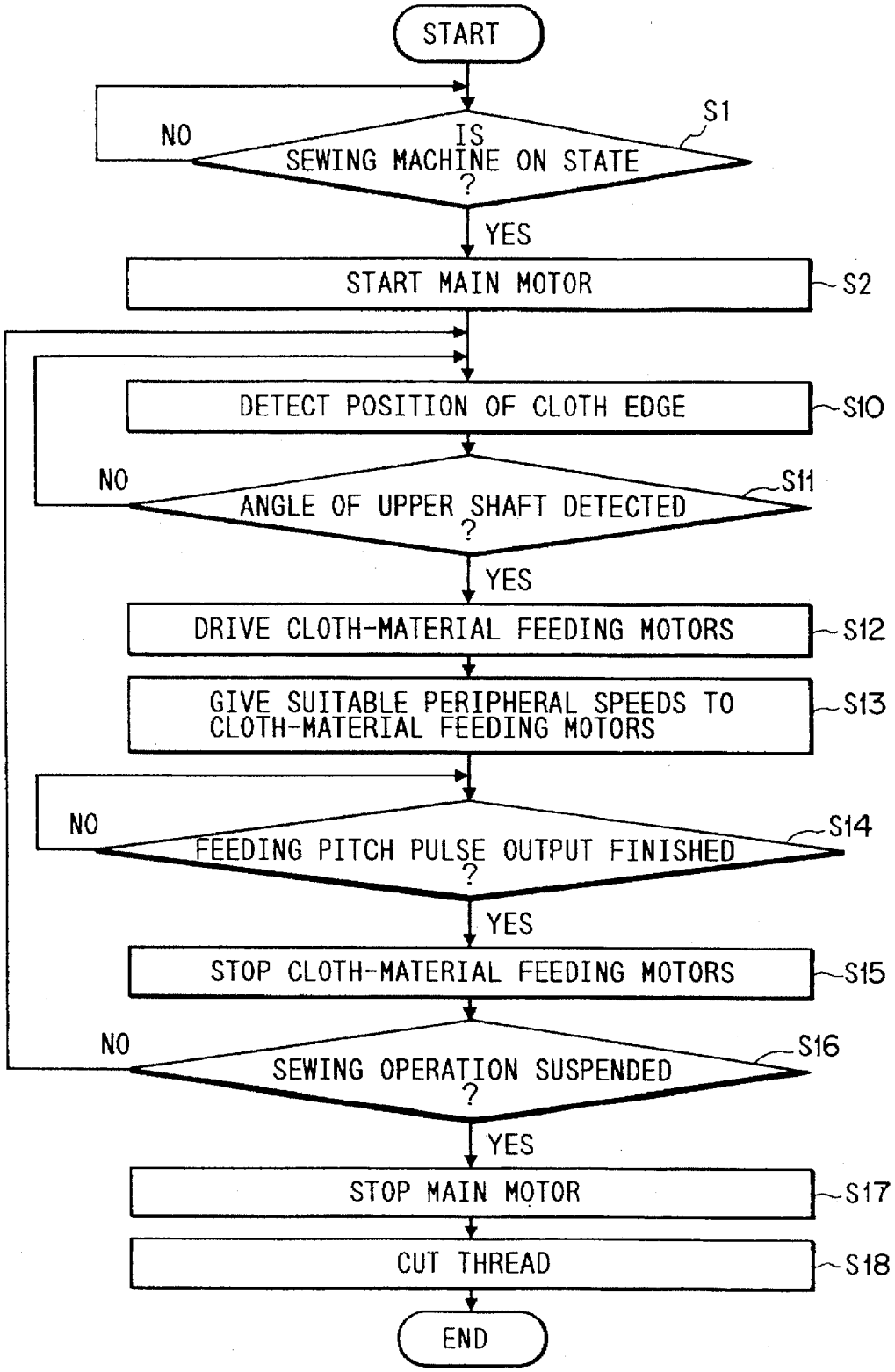
FIG. 9 is a flow chart showing a program stored in the controller in the case where the cloth material is moved intermittently.

The flow chart of FIG. 8 is for the case where the cloth materials are continuously fed.

Upon start of the program, in Step S1, it is determined whether or not the sewing machine is in an "on" state. If the sewing machine is in an "off" state, then the determination is repeatedly carried out until the sewing machine is placed in an "on" state. When it is determined that the sewing machine is in an "on" state, then Step S2 is effected. In Step S2, the main motor of the sewing machine is started. Thereafter, in Step S3, the results of operations by the controller (CPU) 11 are applied, as instruction signals, to the motor drivers 11AL, 11AR, 11UL and 11UR, to drive the upper-cloth-material feeding motors MAL and MAR and the lower-cloth-material feeding motor MUL and MUR. Then, in Step S4, the positions of the cloth edges of the upper cloth material and the lower cloth material are detected.

During detecting the position of the cloth edge, the planar light emitting LED panel 3 is in an "on" state. The solar cell 4 when covered in its entirety by the cloth material 107 receives no light whereas the solar cell 4 when partially covered with the cloth material 107 receives light. An analog signal corresponding to the quantity of light received by the solar cell 4 is amplified by the amplifier 7. The output signal of the amplifier 7 is applied to the A/D converter 8, where it is converted into a digital signal, which is applied to the controller 11. A data table has been stored in the controller 11 which indicates relationships between amounts of light interception (the digital signals from the A/D converter 8) and cloth edge positions so that a cloth edge position can be detected from a given amount of light interception (X of FIG. 3).

After the position of the cloth edge has been detected in the above-described manner, Step S5 is effected. In Step S5, a margin to sew up at the needle position A is set to a predetermined value, and suitable peripheral speeds which have suitable ratios described later are used to drive the upper-cloth-material feeding rollers 6AL and 6AR and the lower-cloth-material feeding rollers 6UL and 6UR so that the speed of the materials movement is constant.

A method of determining peripheral speeds for the feeding rollers will be described with reference to FIGS. 6 and 7.

Figure 6:
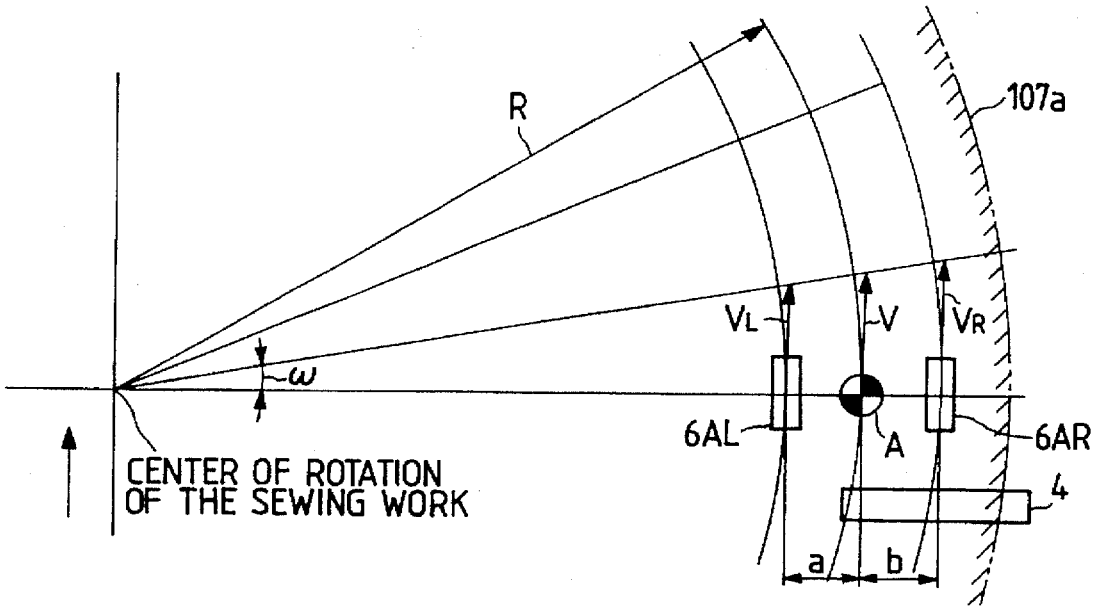
FIG. 6 is an explanatory diagram for a description of a method of calculating the peripheral speeds of cloth material feeding rollers in the case where the cloth edge curve is an out-curve.
Figure 7:
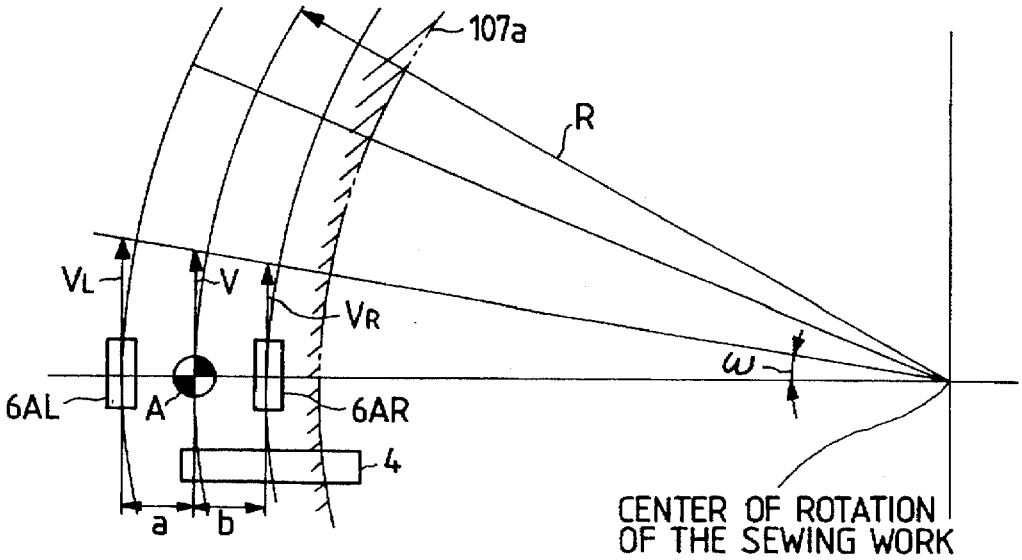
FIG. 7 is an explanatory diagram for a description of a method of calculating the peripheral speeds of cloth material feeding rollers in the case where the cloth edge curve is an in-curve.

FIG. 6 is for the case where the cloth edge 107*a* is of out-curve, and FIG. 7 is for the case where the cloth edge 107*a* is of in-curve. The method will be described with reference to the upper-cloth-material feeding rollers 6AL and 6AR by way of example.

In FIGS. 6 and 7, and in both of the aforementioned cases, $V_L$ is the peripheral speed of the upper-cloth-material feeding roller 6AL on the left side, $V_R$ is the peripheral speed of the upper-cloth-material feeding roller 6AR on the right side, V is the speed of the cloth material at the needle point A, R is the distance between the center of rotation of the sewing work and the needle position A (the sewing curve), a is the distance between the needle position A and the feeding roller 6AL, b is the distance between the needle position A and the feeding roller 6AR, and ω is the angular velocity, In order not to stretch the cloth materials, it is necessary that three angular velocities ω at A, 6AL and 6AR are the same for one sewing curve R, In the case of the out-curve in FIG. 6, $$\omega=V_L/(R-a)=V/R=V_R/(R+b) \quad (1)$$

In the case of the in-curve in FIG. 7, $$\omega=V_L/(R+a)=V/R=V_R/(R-b) \quad (2)$$

It is assumed that the speed of rotation of the sewing machine is n (rpm), and a stitch pitch is P (mm), then relation between them, $$V=P\times n/60 \quad (3)$$

Therefore, as for the out-curve, from Equations (1) and (3), $$V_L=(R-a)\ V/R=(R-a)\ P\ n/60\ R \quad (4a)$$

$$V_R=(R+b)\ V/R=(R+b)\ P\ n/60\ R \quad (4b)$$

As for the in-curve, from Equations (2) and (3), $$V_L=(R+a)\ V/R=(R+a)\ p\ n/60\ R \quad (4c)$$

$$V_R=(R-b)\ V/R=(R-b)\ p\ n/60\ R \quad (4d)$$

Figure 5A:
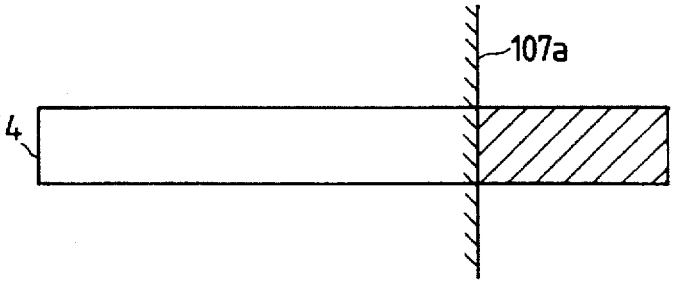
FIGS. 5(*a*) to 5(*c*) are explanatory diagrams for a description of the relationships of the position and curvature of the edge of a cloth material with the light-intercepted areas of the line sensor.
Figure 5B:
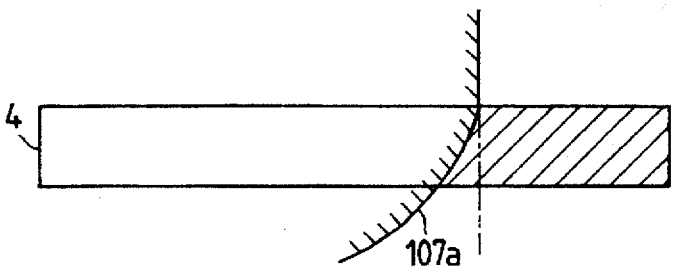
Figure 5C:
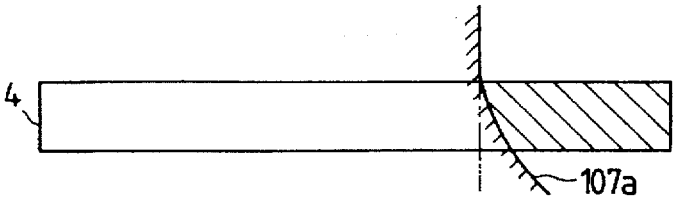

The above-described sewing curve (curvature) R can be obtained from cloth edge position data provided by the solar cell 4. That is, the sewing curve R can be determined as follows: In the case where, as is apparent from the comparison of FIGS. 5(*a*) and 5(*b*), the state of the solar cell changes; that is, the quantity of light received by the solar cell is increased, the sewing curve is an out-curve, and R=50 for instance; and in the case where, as is seen from the comparison of FIGS. 5(*a*) and 5(*c*), the quantity of light received by the solar cell is decreased the sewing curve is an in-curve, and R=100 for instance.

Hence, the peripheral speeds of the upper-cloth-material feeding rollers 6AL and 6AR are determined from the aforementioned cloth edge data.

The peripheral speeds of the lower-cloth-material feeding rollers 6UL and 6UR are also determined in the same manner.

After rotational speed (rpm) according to the peripheral speeds to be given to the upper-cloth-material feeding rollers 6AL and 6AR and the lower-cloth-material feeding rollers 6UL and 6UR have been determined in the above-described manner, pulse signals are applied to the frequency dividers 10AL, 10AR, 10UL and 10UR to rotate the rollers 6AL, 6AR, 6UL and 6UR as required. The pulse signals are subjected to frequency division in the frequency dividers 10AL, 10AR, 10UL and 10UR, the outputs of which are applied to the motor drivers 11AL, 11AR, 11UL and 11UR, respectively, so that the latter output signals to rotate the upper-cloth-material feeding motors MAL and MAR and the lower-cloth-material feeding motor MUL and MUR at desired speeds (rpm). Thus, the operations in Step S5 have been achieved.

Thereafter, in Step S6, it is determined whether or not the sewing operation is to be continued as it is. When it is determined that the sewing operation is to be continued, Step S4 is effected again. When, on the other hand, it is determined that the sewing operation is to be suspended, Step S7 is effected. In Step S7, the main motor is stopped. Thereafter, in Step S8, the controller (CPU) 11 applies a motor stopping instruction to the motor drivers 11AL, 11AR, 11UL and 11UR, to stop the upper-cloth-material feeding motors MAL and MAR and the lower-cloth-material feeding motors MUL and MUR, and then Step S9 is effected. In Step S9, the thread is cut. Thus, the routine has been ended.

Now, the operation of the cloth edge control device in feeding the cloth materials intermittently, will be described with reference to FIG. 9. Intermittently operation includes a cloth material sewing interval where the cloth materials are sewed, and a cloth material feeding interval where cloth materials are only fed.

The flow chart of FIG. 9 is different from the flow chart of FIG. 8 in following steps.

In Step S10, in the cloth material sewing interval, the cloth edge position is detected similarly as in the above-described case where the cloth materials are fed continuously, and then Step S11 is effected. In Step S11, the angle Y of the upper shaft 1*a* is detected which is provided a the start of a cloth material feeding operation. In Step S12, drive signals are applied to the upper-cloth-material feeding motors MAL and MAR and the lower-cloth-material feeding motors MUL and MUR in Step S12, and then Step S13 is effected. Next, in Step S13, the margin to sew up at the needle location A is set to a predetermined value, and suitable peripheral speeds which have suitable ratios described later are used to drive the upper-cloth-material feeding rollers 6AL and 6AR and the lower-cloth-material feeding rollers 6UL and 6UR so that the speed of the cloth materials movement is constant and the amount of rotation is constant at the needle location A by the beginning of cloth feeding.

A method of determining speed ratios for the feeding rollers will be described with reference to FIGS. 6 and 7 similarly as in the case where the cloth materials are fed continuously.

It is assumed that the cloth materials are moved as much as a stitch pitch of P (mm) for a period of time of t (s), In order not to stretch the cloth materials, it is necessary that three angular velocities ω at A, 6AL and 6AR are the same for one sewing curve R, In the case of the out-curve in FIG. 6, $$\begin{aligned} P &= R\,V_L\,t/(R-a) \\ &= R\,V\,t/R \\ &= R\,V_R\,t\,(R+b) \end{aligned} \tag{1'}$$

In the case of the in-curve in FIG. 7, $$\begin{aligned} P &= R\,V_L\,t/(R+a) \\ &= R\,V\,t/R \\ &= R\,V_R\,t\,(R-a) \end{aligned} \tag{2'}$$

Therefore, if it is assumed that, in the case of the out-curve, the amounts of rotation of the right and left feeding rollers are represented by $P_R$ and $P_L$, respectively, then $$P_L=V_L\,t=P\,(R-a)/R$$

$$P_R=V_R\,t=P\,(R+b)/R$$

If it is assumed that the cloth material feeding interval is Y° out of 360° in measuring the rotation angle of the upper shaft, then $$V_L=360\,(R-a)\,P\,n/(60\times R\times Y)$$

$$V_R=360\,(R+b)\,P\,n/(60\times R\times Y)$$

Furthermore, if it is assumed that, in the case of the in-curve, the amounts of rotation of the right and left feeding rollers are represented by $P_R$ and $P_L$, respectively, then $$P_L=V_L\,t=P\,(R+a)/R$$

$$P_R=V_R\,t=P\,(R-b)/R$$

If it is assumed that the cloth material feeding interval is Y° out of 360° in measuring the rotation angle of the upper shaft, then $$V_L=360\,P\,n\,(R+a)/(60\,R\,Y)$$

$$V_R=360\,P\,n\,(R-b)/(60\,R\,Y)$$

Thus, the peripheral speeds and the amounts of rotation of the upper-cloth-material feeding rollers 6AL and 6AR and the lower-cloth-material feeding rollers 6UL and 6UR are determined according to the cloth edge data and the cloth material feeding interval.

In Step S14, it is determined whether or not a feeding pitch pulse output is finished. If the feeding pitch pulse output is not finished, feeding is operated until the feeding pitch pulse output is finished. When the feeding pitch pulse is finished, then Step S15 is effected.

In Step S15, the controller 11 applies a motor stopping instruction to the motor drivers 11AL, 11AR, 11UL, and 11UR to stop the upper-cloth material feeding motors MAL and MAR, and the lower-cloth material feeding motors. Then Step S16 is effected.

In Step S16, it is determined whether or not the sewing operation is to be continued as it is. When it is determined that the sewing operation is to be continued, Step S10 is effected again. When, on the other hand, it is determined that the sewing operation is to be suspended Step 10 is effected. In Step S17, the main motor is stopped. And then in Step S18, the thread is cut. Thus the routine has been ended.

As is apparent from the above description, in the embodiment, the controller 11 detects the positions 107*a* and the curvatures R of the cloth material edges according to the light intercept signals of the line sensors (the solar cells 4), and controls the rotations of the rollers 6AL, 6AR, 6UL and 6UR according to the positions and curvatures thus detected. Hence, the margin to sew up and the cloth material feeding operation can be controlled concurrently with the rollers the directions of rotation of which are coincident with the cloth material feeding direction B. Hence, the difficulty is eliminated that the cloth materials are stretched before the needle location A, and the occurrence of the feed pitch error and the misalignment is prevented.

Furthermore, in the embodiment, the pulse signal generated in association with the rotation of the upper shaft 1*a* of the sewing machine is utilized as the fundamental clock signal for the frequency dividers 10AL, 10AR, 10UL and 10UR adapted to frequency-divide the roller drive signals. Hence, even when the speed of the sewing machine is not constant as in the case where the sewing machine has just started, the rollers are operated in synchronization with the upper shaft 1*a* of the sewing machine. And the means for operating the rollers in this manner is simple in construction, being not mechanical.

In the above-described embodiment, the encoder 9 is employed as the pulse generator; however, it may be replaced with a tachometer generator.

Furthermore, the planar light emitting LED panel 3 is employed as the light emitting elements of the optical line sensor; however, linear incandescent lamps may be employed.

Figure 10:
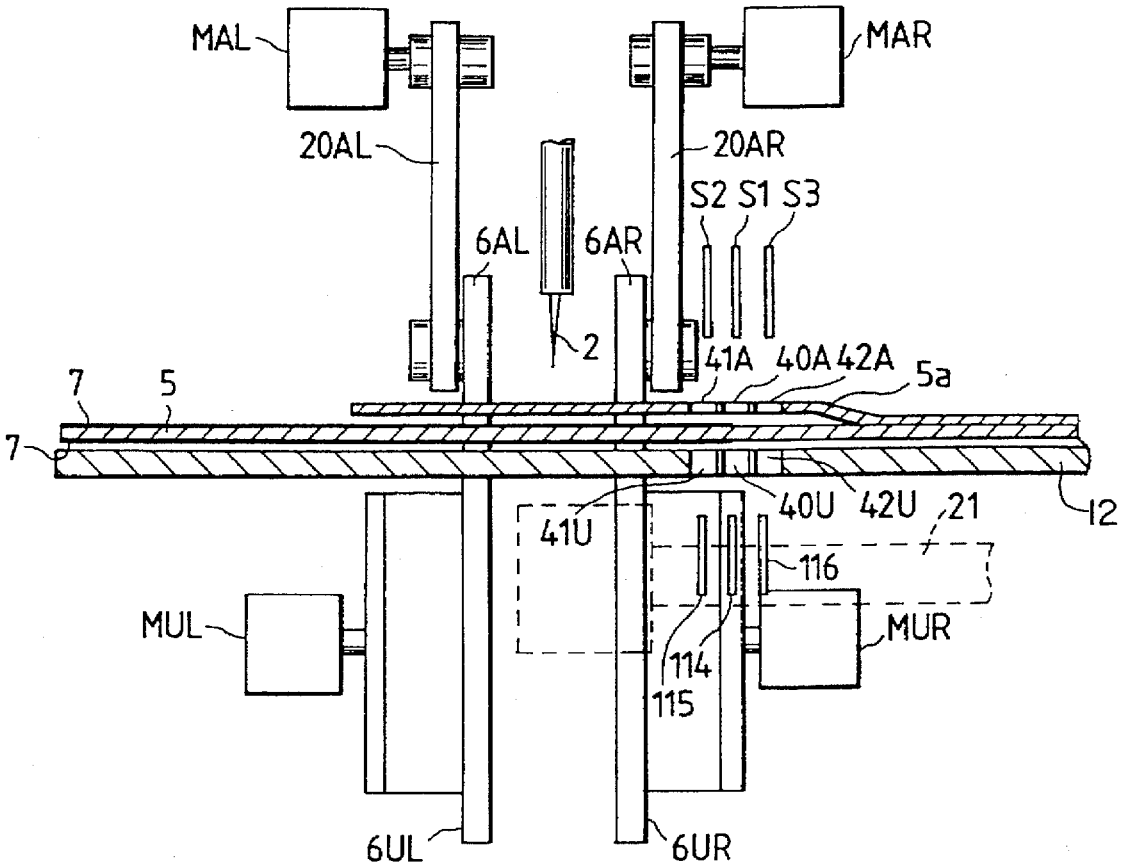
FIG. 10 is an explanatory diagram showing the arrangement of essential parts of another embodiment of the cloth edge control device.
Figure 11:
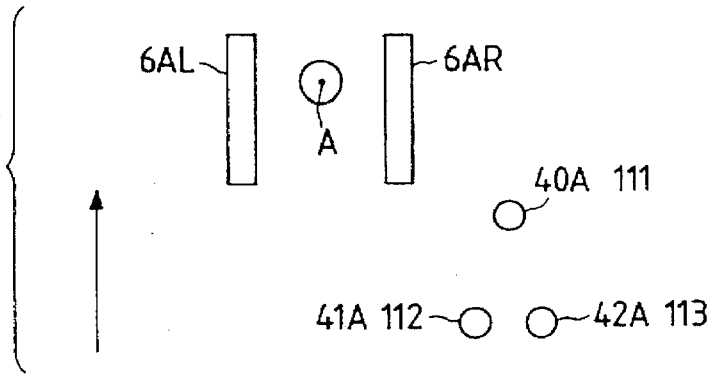
FIG. 11 is a top view showing a needle location of the device shown in FIG. 10, and parts around it.

FIG. 10 is an explanatory diagram showing essential parts of another example of the cloth edge control device, which constitutes a second embodiment of the invention. FIG. 11 is a top view of a needle position A and parts near it in the cloth edge control device shown in FIG. 10. In FIGS. 10 and 11, parts corresponding functionally to those which have been described with reference to the first embodiment are therefore designated by the same reference numerals or characters.

The second embodiment is different from the above-described first embodiment as follows: each of the optical line sensors according to the first embodiment includes the planar light emitting LED panel 3 and the solar ell 4. Each of a plurality of optical reflection type point sensors according to the second embodiment includes a light emitting element and a light receiving element are employed (three point sensors for each of the upper and lower cloth materials).

The optical point sensors 111, 112 and 113 for the upper cloth material (hereinafter referred to as "upper cloth material point sensor 111, 112 and 113", when applicable), and the optical point sensors 114, 115 and 116 for the lower cloth material (hereinafter referred to as "lower cloth material point sensors 114, 115 and 116", when applicable) are arranged upstream against the needle location A as shown in FIG. 11. As shown in FIG. 10, light transmitting through-holes 40A, 41A and 42A are formed in an upper cloth guide 5*a* in such a manner as to confront with the upper cloth material point sensors 111, 112 and 113, respectively; and similarly, light transmitting through-holes 40U, 41U, and 42U are formed in the throat plate 12 in such a manner as to confront with the lower cloth material point sensors 114, 115 and 116, respectively.

In FIG. 10, reference characters 20AL and 20AR designate belts; and 21, a shuttle. The point sensors 111 through 116 are connected to the controller 11 similarly as in the case of the above-described first embodiment.

When no cloth material 107 appears in the ranges of light beams from the point sensors 111 through 116; that is, in the through-holes 40A, 41A, 42A, 40U, 41U and 42U, the point sensors apply low level signals ("0") to the controller 11; whereas when the cloth material appears therein, the point sensors apply high level signal ("1") to the controller 11. The controller 11 determines the angle of the edge 107*a* of the cloth material 107; i.e., the posture of the cloth material edge according to the high and low level signals.

A data table has been stored in the controller 11 which indicates the relationships of the high and low level signals provided by the point sensors 111 through 116 with the speed ratios and the amounts of rotation of the upper-cloth-material feeding rollers 6AL and 6AR and the lower-cloth-material feeding rollers 6UL and 6UR. That is, the peripheral speeds and the amounts of rotation of the upper-cloth-material feeding rollers 6AL and 6AR and the lower-cloth-material feeding rollers 6UL and 6UR are controlled according to the data table. The data table is as indicated below:

Data Table

| S1 S4 | S2 S5 | S3 S8 | $V_R/V_L$ ($V_R > V_L$) $V_L/V_R$ ($V_R < V_L$) | $P_R$, $P_L$ |
|---|---|---|---|---|
| 0 | 0 | 0 | $V_R/V_L$ = middle | $P_R >> P_L$ |
| 0 | 0 | 1 | $V_R = V_L$ | $P_R = P_L$ |
| 0 | 1 | 0 | $V_R/V_L$ = small | $P_R > P_L$ |
| 0 | 1 | 1 | $V_L/V_R$ = large | $P_R <<< P_L$ |
| 1 | 0 | 0 | $V_R/V_L$ = large | $P_R >>> P_L$ |
| 1 | 0 | 1 | $V_R = V_L$ | $P_R = P_L$ |
| 1 | 1 | 0 | $V_L/V_R$ = small | $P_R < P_L$ |
| 1 | 1 | 1 | $V_L/V_R$ = middle | $P_R << P_L$ |

The operation of the cloth edge control device is performed according to the flow chart which is similar to the one for the above-described first embodiment.

As was described above, the controller 11 receives the light intercept signals from a plurality of point sensors 111, 112 and 113 (114, 115 and 116) to detect the posture of the cloth material edge 107*a*, and controls the rotations of the rollers 6AL, 6AR, 6UL and 6UR according to the data thus detected. Hence, the margin to sew up and the cloth material feeding operation can be controlled concurrently with the rollers the directions of rotation of which are coincident with the cloth material feeding direction B. Hence, the difficulty is eliminated that the cloth materials are stretched before the needle location A, and the feed pitch error and the misalignment are prevented.

In the second embodiment, three optical point sensors are employed for each of the upper and lower cloth materials; however, the invention is not limited thereto or thereby: that is, the number of optical point sensors should be determined according to whether or not it is sufficient to detect the posture of the cloth material 107.

While there has been described in connection with the preferred embodiments of this invention, it will be obvious to those skilled in the art that various changes and modifications may be made therein without departing from the invention. In each of the above-described embodiments, the edges of two pieces of cloth materials are detected, and the cloth materials are automatically sewed together while the cloth edges being controlled in position. However, it goes without saying that the technical concept of the invention is applicable to a cloth edge control device which detects the edge of a piece of cloth material to perform a cloth edge control operation.

As was described above, with the cloth edge control device according to the present invention, the controller detects the position and curvature of the edge of the cloth material according to the light intercept signal provided by the line sensor, and controls the cloth material feeding rollers according to the data thus detected. Hence, the margin to sew up and the cloth material feeding operation are controlled concurrently with the feeding rollers the direction of rotation of which is coincided with the cloth material feeding direction. Therefore, the difficulty is eliminated that the cloth material is stretched before the needle location, whereby the occurrence of the feed pitch error or the misalignment is prevented.

Alternatively, the controller detects the posture of the cloth material according to the light intercept signals provided by the plurality of point sensors, and controls the cloth material feeding rollers according to the data thus detected. Hence, the margin to sew up and the cloth material feeding operation are controlled concurrently with the feeding rollers the direction of rotation of which is coincided with the cloth material feeding direction. Therefore, the difficulty is eliminated that the cloth material is stretched before the needle location, whereby the occurrence of the feed pitch error or the trouble misalignment is prevented.

Furthermore, in the device according to the present invention, the pulse signal generated in association with the rotation of the upper shaft of the sewing machine is employed as the fundamental clock signal for the frequency dividers adapted to frequency-divide the roller drive signal provided by the controller. Therefore, the rollers are operated in synchronization with the upper shaft of the sewing machine with relatively simple means.

What is claimed is:

1. A cloth edge control device for a sewing machine, comprising:

a pair of rollers adapted to be positioned near a needle location, said rollers being rotatable about an axis perpendicular to a direction in which a cloth material is fed and being pushed against fed cloth material;

an optical sensor for detection of fed cloth material at a plurality of points on a line along a direction intersecting the feed direction; and control means for detecting the position and curvature of the edge of fed cloth material according to light intercept signals from said optical sensor, and for rotating said rollers independently of each other according to said position and curvature thus detected.

2. A cloth edge control device as claimed in claim 1, further comprising:

a pulse generator for generating a pulse signal; and frequency dividers for dividing a roller drive signal from said control means, said pulse signal output of said pulse generator serving as a fundamental clock.

3. A cloth edge control device as claimed in claim 1, wherein said control means comprises:

a memory portion for storing a data table of relationships between said light intercept signals, a position and a curvature of the cloth edge;

a margin and curvature detecting portion for determining a margin to sew up and detecting a curvature of the cloth edge from said light intercept signals referring to said data table;

a speed calculating portion for calculating an angular velocity in order for cloth material to be fed at constant speed at said needle location, and for calculating a peripheral speed of each of said rollers using said curvature, said angular velocity and distances between said needle location and said rollers; and a roller control portion for controlling said rollers to rotate at respective speeds calculated by said speed calculating portion.

4. A cloth edge control device as claimed in claim 1, wherein said pair of rollers are spaced from one another and adapted to be positioned with the needle location between the rollers.

* * * * *